United States Patent [19]

Fiedler et al.

[11] Patent Number: 4,481,763

[45] Date of Patent: Nov. 13, 1984

[54] ARRANGEMENT OF ELECTRODES FOR MONITORING THREAD BREAKAGE IN RING SPINNING MACHINES

[75] Inventors: Gerhard Fiedler, Greiz; Werner Fritzsche, Greiz-Moschwitz; Frank Herold; Uwe Tolkmitt, both of Greiz, all of German Democratic Rep.

[73] Assignee: VEB Kombinat Wolle und Seide, Meerane, German Democratic Rep.

[21] Appl. No.: 389,144

[22] Filed: Jun. 16, 1982

Related U.S. Application Data

[63] Continuation-in-part of Ser. No. 251,811, Apr. 7, 1981, Pat. No. 4,420,697.

[30] Foreign Application Priority Data

Jun. 17, 1981 [DD] German Democratic Rep. ... 230878

[51] Int. Cl.[3] ..... D01H 13/16; D01H 13/32

[52] U.S. Cl. ..... 57/81; 57/264

[58] Field of Search ..... 57/81, 264, 265

[56] References Cited

U.S. PATENT DOCUMENTS

| | | | |
|---|---|---|---|
| 3,844,101 | 10/1974 | Schwartz | 57/81 |
| 3,899,868 | 8/1975 | Lee et al. | 57/81 X |
| 4,023,341 | 5/1977 | Saino et al. | 57/81 |
| 4,122,657 | 10/1978 | Felix | 57/81 |
| 4,160,360 | 7/1979 | Carvalho et al. | 57/81 |
| 4,311,958 | 1/1982 | Aeppli | 57/265 X |

*Primary Examiner*—Donald Watkins

*Attorney, Agent, or Firm*—Jordan and Hamburg

[57] ABSTRACT

An arrangement of electrodes for monitoring thread breakage on ring spinning machines for a sufficiently strong reception of the electric charge of the running thread for generating a signal that can be further processed, in which an electrode (3) is arranged in the proximity of the moving thread (1) between a stretching mechanism (2) and a thread guide (4), preferably on the thread guide (4) on a displacable or turnable insulated body (5), or such electrode (3) with insulated body (5) is positioned on a balloon constricting ring (6), adjustable through displacement or turning of the insulated body (5) in such a way that the thread (1) is not permanently in front of this electrode (3), this electrode (3) being connected by means of an insulated line to an electronic circuit or directly to an electronic circuit.

6 Claims, 3 Drawing Figures

ARRANGEMENT OF ELECTRODES FOR MONITORING THREAD BREAKAGE IN RING SPINNING MACHINES

REFERENCE TO RELATED APPLICATIONS

This is a continuation-in-part of application Ser. No. 251,811, filed Apr. 7, 1981, now U.S. Pat. No. 4,420,697.

BACKGROUND OF THE INVENTION AND PRIOR ART STATEMENT

This invention relates to an arrangement of electrodes for monitoring thread breakage in ring spinning machines, in methods for monitoring thread breakages which sense the electric charge on the moving thread, thus providing information on thread run and thread breakage.

It has been known that information on thread run and thread breakage in ring spinning machines can be obtained based on the electric charge of the thread by means of sensing electrodes provided on the thread or in the vicinity of the thread. In the known systems, the electric charge of the thread generates an opposing charge on the electrode which is then converted by electronic circuits into a further processable signal. Previously, electrodes of various forms, for instance, plane, concave or convex, have been proposed for such purpose.

For optimal formation, i.e., arrangement of the electronic circuit, it is necessary to arrange the electrodes at the operating points of a ring spinning machine in such a way that the charge of the thread can be received with sufficient strength.

Nothing has been known up to now about such arrangements of electrodes for monitoring the thread run at the operating points of ring spinning machines.

The invention has the object of providing an arrangement which makes it possible to monitor the thread run on ring spinning machines by means of electrodes.

SUMMARY OF THE INVENTION

It is the object of the invention to provide arrangements of electrodes for monitoring the thread run at the operating points of ring spinning machines which permit reception of the electrical charge of the running thread in a sufficiently strong manner and generation of a signal that can be further processed.

In accordance with the invention, this object is accomplished by arranging a metallic electrode that has been insulated in the proximity of the moving thread between a stretching mechanism and a thread guide and/or on a balloon constricting ring adjustable through displacement or turning of an insulated body, and connecting the electrode through an insulated line to an electronic circuit. The thread is not permanently positioned adjacent the electrode on the balloon constricting ring, but is always positioned adjacent the electrode on the thread guide.

In accordance with this invention, the object may also be accomplished by affixing the electrode on the thread guide in an adjustable manner.

At all arrangement points of the electrode of the invention, it is not necessary to provide an insulated connecting line since the electrode is directly connected to an electronic circuit. Thereby it is possible to receive sufficiently strong charges from the thread and to generate a further processable signal.

BRIEF DESCRIPTION OF THE DRAWINGS

The invention will now be explained by three examples of embodiments.

In the drawing:

FIG. 1 represents an arrangement in which electrode 3 is mounted by means of a clamping fixture of any desired kind in the proximity of moving thread 1, between stretching mechanism 2 and the thread guide 4, on insulating body 5. In this arrangement thread 1 runs past electrode 3 with a speed V and continuously generates an opposing charge on electrode 3, which can be measured as a steady-state signal with random overlays.

Figure 1:
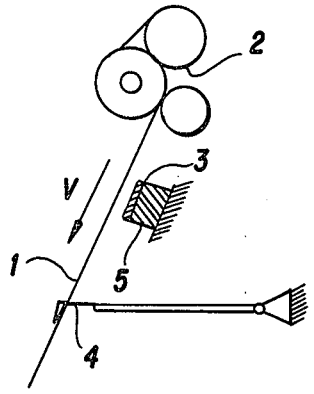
FIG. 1 illustrates an arrangement of the electrode between the stretching mechanism and/or guide thread.
Figure 2:
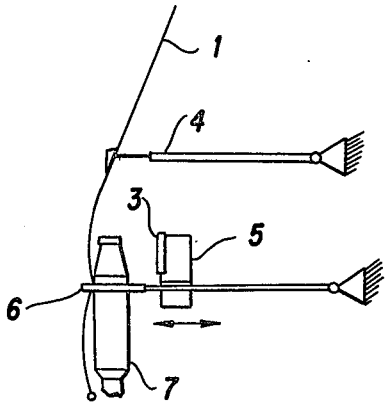
FIG. 2 illustrates an arrangement of the electrode on the balloon constricting ring.
Figure 3:
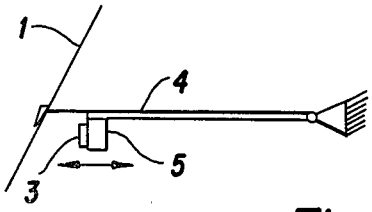
FIG. 3 illustrates the arrangement of the electrode on the thread guide.

Other sufficiently strong results are obtained by the arrangements according to FIG. 2 and FIG. 3. Thread 1 moves past electrode 3 at the revolution speed of spindle 7 which is arranged on insulated body 5, being either, according to FIG. 2, affixed on balloon constricting ring 6 or, according to FIG. 3, on thread guide 4, or with an electrode being arranged at each point. In view of the higher speed compared to FIG. 1, stronger charges are received which can be especially well evaluated, as thread 1 is not permanently positioned before the electrode 3 and, for this reason, a variable charge is received on electrode 3, whose frequency is proportional to the revolution number of the spindle 7. The electrode can be adjusted through displacement or turning of insulated body 5 on balloon constricting ring 6 or thread guide 4.

These arrangements make it possible to receive sufficiently strong charges with electrode 3 for further processing.

If two electrodes are provided, as shown in FIGS. 1 and 2, it is possible to obtain a still stronger processable signal with an appropriate evaluation circuit.

We claim:

1. An electrode arrangement for monitoring thread breakage in ring spinning machines for receiving a sufficiently strong electric impulse of running thread and producing a further processable signal, comprising
   - (A) a thread stretching machine for feeding running thread,
   - (B) a guide for guiding the running thread, whereby the thread passes directly from said stretching mechanism to said guide,
   - (C) an adjustable electrode arranged in the vicinity of said passing thread and spaced therefrom, said electrode (C) receiving an electrostatic charge from the passing thread and in turn, transmitting a signal to an electronic circuit, and
   - (D) an insulated body supporting said electrode, said electrode being adjustable by displacement or turning of said insulated body.

2. The arrangement of claim 1 in which said electrode and insulated body are positioned on the thread guide.

3. The arrangement of claim 1 additionally comprising
   - (E) a rotating spindle positioned after said thread guide, and
   - (F) a ring for constricting said passing thread against said rotating spindle, and further comprising an electrode and insulated body positioned on said constricting ring.

4. The arrangement of claim 1 in which said electrode is directly connected to the electronic circuit.

5. The arrangement of claim 1 in which said electrode is connected to the electronic circuit by way of an insulated line.

6. The arrangement of claim 2 additionally comprising (E) a rotating spindle positioned after said thread guide, (F) a ring for constricting said passing thread against said rotating spindle, (G) an additional insulated body positioned on said constricting ring, and (H) an additional electrode for receiving an impulse from the passing thread and supported on said additional insulated body, in which said first mentioned and additional electrodes are each connected with their own respective electronic circuits.

* * * * *